United States Patent [19]

Taylor

[11] 3,986,322

[45] Oct. 19, 1976

[54] BAGGING MACHINE WITH AUTOMATIC VALVE BAG PLACER

[76] Inventor: Murland L. Taylor, 5300 Main, Parsons, Kans. 67357

[22] Filed: Feb. 12, 1976

[21] Appl. No.: 657,476

[52] U.S. Cl. ..... 53/188; 53/384; 279/4; 279/109

[51] Int. Cl.[2] ..... B65B 43/26

[58] Field of Search ..... 53/187, 188, 384; 279/4, 106, 109

[56] References Cited

UNITED STATES PATENTS

| | | | |
|---|---|---|---|
| 2,922,612 | 12/1955 | Bulls et al. | 53/187 X |
| 3,287,879 | 11/1966 | Miller | 53/188 |

*Primary Examiner*—Travis S. McGehee
*Attorney, Agent, or Firm*—Robert E. Breidenthal

[57] ABSTRACT

Bag placing apparatus for use in conjunction with automatic bag filling equipment of the type that fills valve type bags through a horizontal spout that is received within the bag valve when the bag is properly positioned for filling on the spout; such bag filling equipment cyclicalling alternately between fill and filled bag discharge intervals respectively initiated automatically by placement of an empty bag on the spout and upon completion of the filling of such bag.

The bag placing apparatus includes a placer provided with vacuum bag holders and a relatively movable snapper. An articulated support inclusive of a slide mounting and cam guides are provided which concurrently upon initiation of the filled bag discharge interval commences sequentially (a) to separate an empty bag from a horizontal stack of bags, (b) to grip the bag by the snapper, (c) to move the placer and the bag held thereby toward the spout, while the snapper moves relative to the placer to open the valve, and (d) to move the bag to receive the spout within the valve after the bag has been turned to change the valve from a vertical to a horizontal orientation.

Upon completion of placement of the bag on the spout, the fill interval is initiated whereupon the snapper is caused to open and release its grip on the bag until it next grips a bag as previously described, and the placer is caused to travel reversely the previously described path thereof to cause the same to hold by vacuum the next bag of the stack.

The synchronism of the placer and snapper movements with the cyclic operation of the bag filler or packer is pneumatically effected.

22 Claims, 13 Drawing Figures

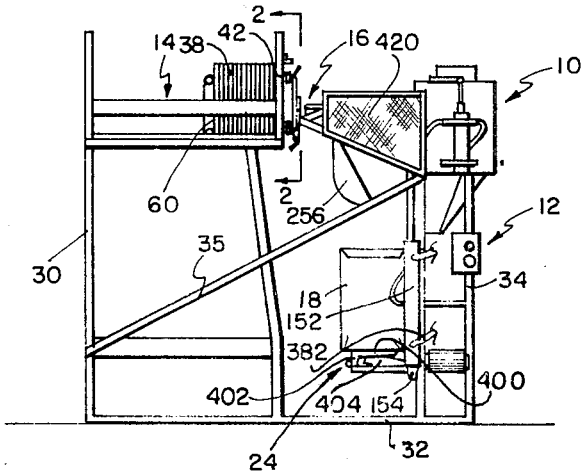
FIG. 1
FIG. 2
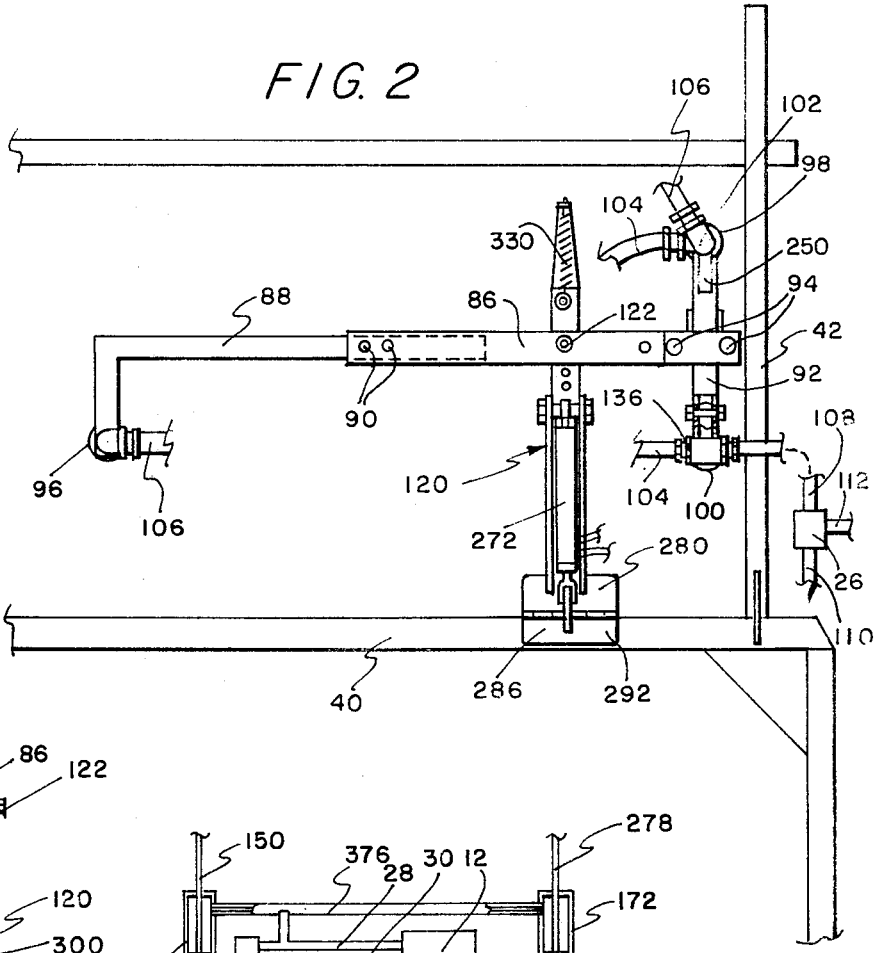
FIG. 3
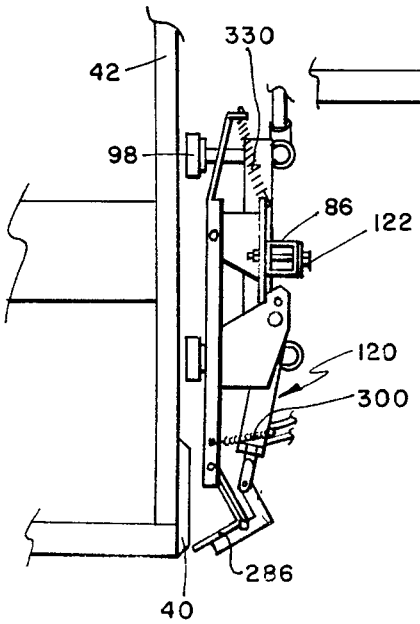
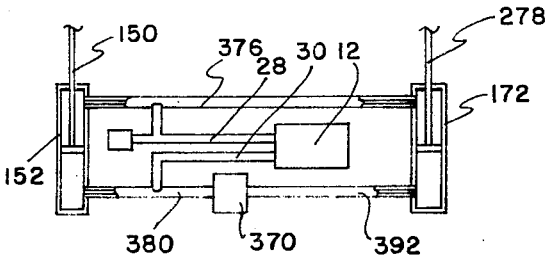
FIG. 13

FIG. 6
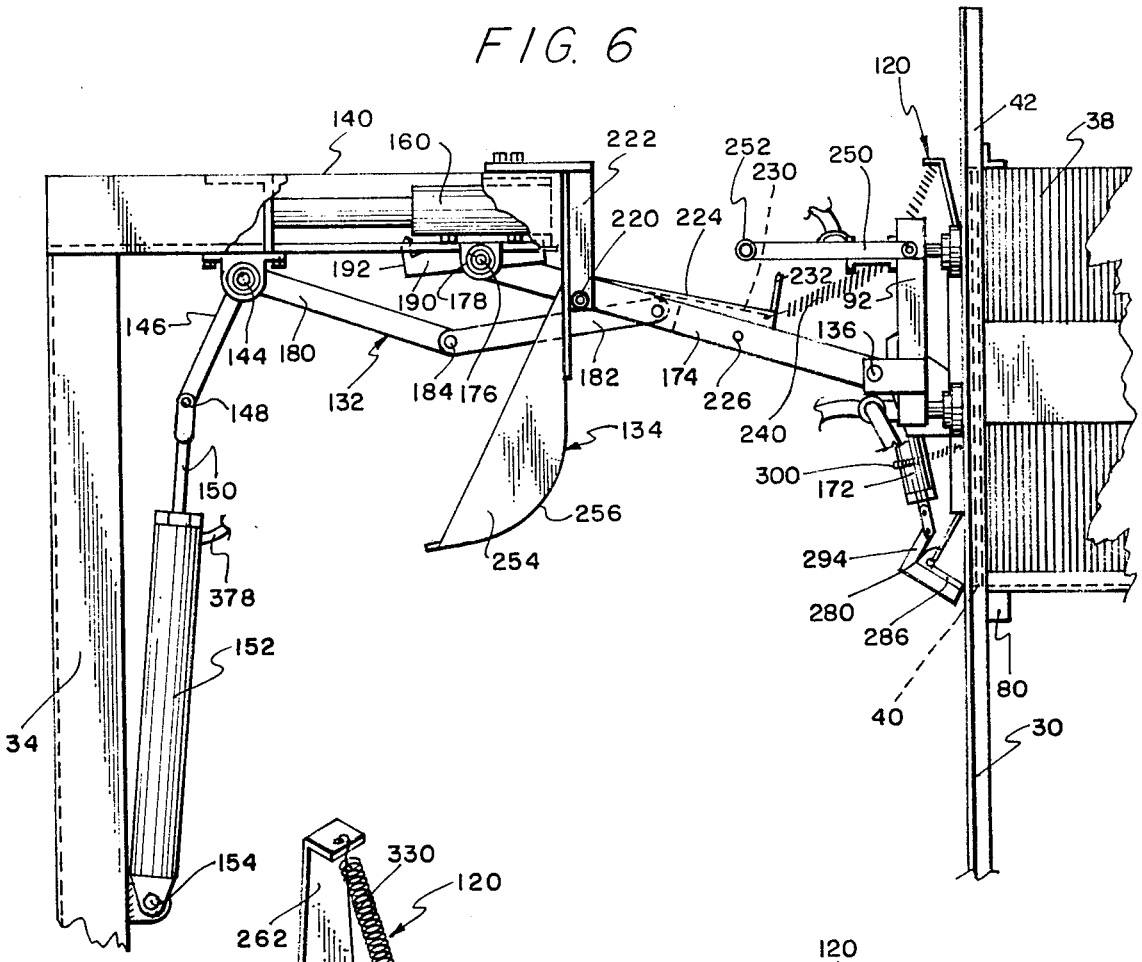
FIG. 7
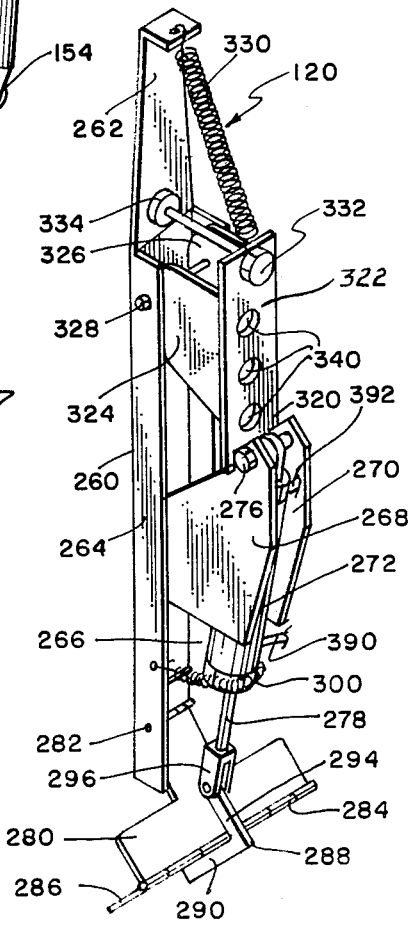
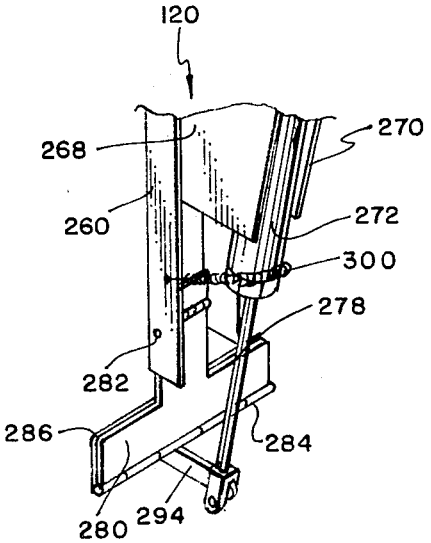
FIG. 8

FIG. 9
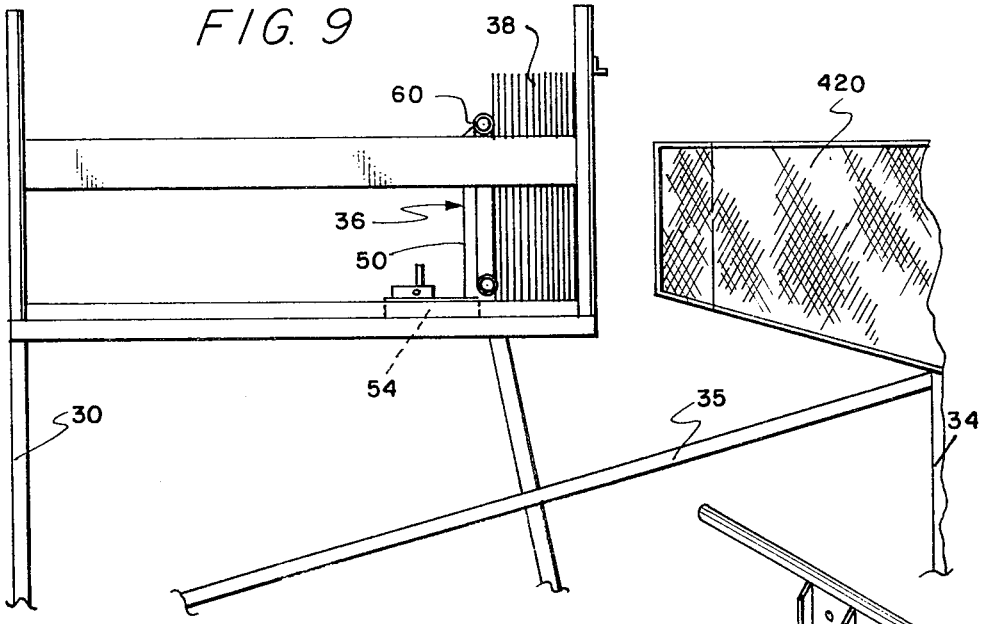
FIG. 10
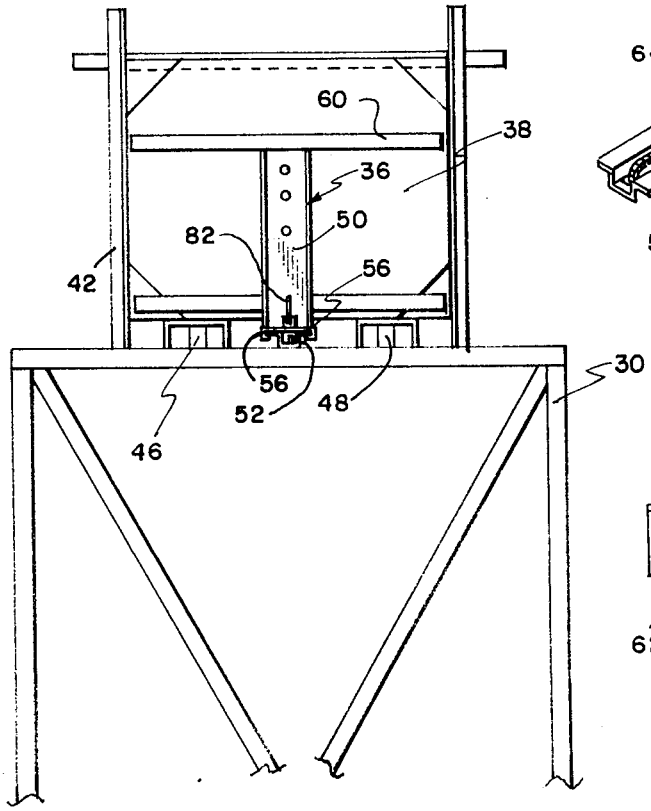
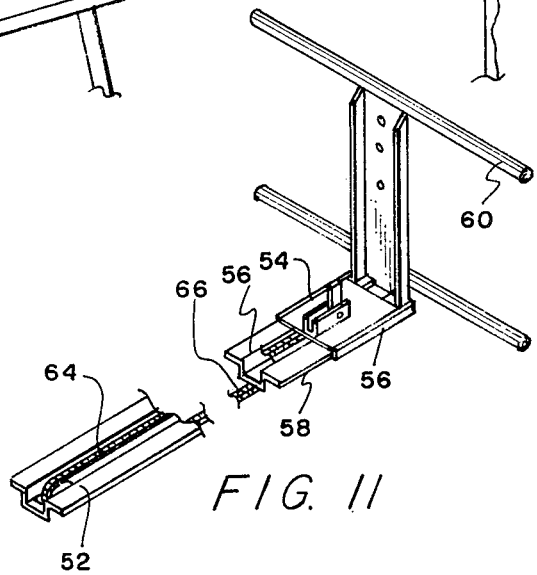
FIG. 11
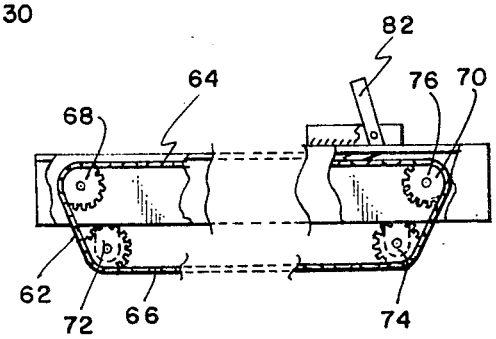
FIG. 12

BAGGING MACHINE WITH AUTOMATIC VALVE BAG PLACER

The present invention relates to new and useful improvements in automatic bagging apparatus, and more particularly pertains to equipment that operates in synchronism with the cycling of a conventional bagging machine to place automatically valve-type bags on the fill spout of the bagging machine.

An appreciation of prior art proposals can be obtained on considering the following list of U.S. patents:

| | | |
|---|---|---|
| 3,466,837 | Sturges | Sept. 16, 1969 |
| 3,691,715 | Kelly et al | Sept. 19, 1972 |
| 3,566,578 | Thorne et al | Mar. 2, 1971 |
| 3,509,689 | Perrin | May 5, 1970 |
| 3,399,507 | Litchard | Sept. 3, 1968 |
| 2,950,589 | Litchard | Aug. 30, 1960 |
| 2,810,999 | Spriggs | Oct. 29, 1957 |
| 2,169,542 | Steinkemper | Aug. 15, 1939 |

As well known by those familiar with the art, conventional automatic bagging machines are in widespread use for filling valve-type bags, such machines including a horizontally projecting fill spout that penetrates or extends into the valve of a bag placed on and suspended from the spout for filling.

Automatic bag filling machines of the character described above often include means for sensing proper placement of a bag in position for filling, whether the bag is positioned by hand or otherwise, and on such sensing the fill portion of a cycle of machine operation is initiated whereupon a clamping device is pneumatically actuated to clamp the top of the bag to the top of the spout and material is air blown into the bag to fill the latter.

Such filling machines also commonly include means to sense that a bag has been filled (ordinarily by monitoring the weight of the bag and its contents), and on sensing completion of such filling, the bag discharge portion of a machine cycle is initiated whereupon the introduction of material is terminated, the pneumatic clamp is released and the filled bag is discharged or removed from the spout by pneumatic discharge means.

After the pneumatic discharge means has operated, the discharge interval will continue until a bag has been positioned for filling so as to initiate again the filling portion of the cycle.

From the foregoing brief outline of the operation of a conventional bagging machine as described above, it will be seen that the same alternates between two conditions or states automatically, namely, bag filling and filled bag discharge. Usually such states or cycle portions are attended by a pair of air lines being alternately coupled to a source of air pressure and vented to the atmosphere; one of such lines being pressurized during the fill interval and the other being pressurized during the filled bag discharge interval.

The paramount object of the present invention is to provide apparatus for sequentially placing individual bags from a stacked supply of the latter on the filling spout of a bagging machine, with such placement being pneumatically powered and pneumatically synchronized with pneumatic operation of the bagging machine.

Another important object of the invention is to provide a positive grip upon a bag as it is being placed upon the spout so as to augment the forces that may be exerted upon a bag, by way of suction or vacuum cups.

Yet another very important object of the invention is to pull apart two portions of a bag as it travels between the stack and the spout so as to open widely the valve of the bag for assuring proper reception of the spout in the valve.

A final important object to be specifically set forth is to provide a placing apparatus such as to admit of convenient reversal of parts so as to handle either right- or left-hand stacks of bags, this is, bags stacked to have their bodies folded to the right or to the left of their valved tops.

A broad aspect of the invention involves a snapper comprising an elongated support member having forward and rear sides, jaw means carried by the support member at an end of the latter for releasably gripping an edge of a flat object disposed at the forward side of the support member, said jaw means comprising inner and outer jaws, said inner jaw having inner and outer edges and being hingedly connected along its inner edge to the support member for forward and rearward swinging movement about a transverse axis, said outer jaw having an inner edge and an outer edge and being hingedly connected along its inner edge to the outer edge of the inner jaw for swinging movement, said jaws having sides adapted to grip an object therebetween when the jaws are both swung in a closing direction that corresponds to forward swinging movement of the inner jaw, and jaw operating means carried by and disposed on the rear side of the support member for controllably swinging the jaws in said closing direction and in a direction opposite thereto to open the jaws.

Another important aspect of the invention is a bag placer system for moving valve-type bags one at a time from a horizontal stack of folded empty bags to place such bag on the horizontal spout of a bag filling machine with the spout received in the valve of the bag, said system comprising a support pivot connected to a placer frame about a horizontal axis that is perpendicular to the spout with respect to the horizontal plane, means for selectively moving the support pivot in either direction along a path disposed in a vertical plane and having a first position relatively adjacent the spout and a second position relatively adjacent the stack, means operative to control the angular orientation of the placer frame about said axis as a function of the position of the support pivot along said path, said orientation of the placer frame differing about 90° when the support pivot is in its first and second positions, and said placer frame being provided with means for releasably holding a bag.

A more limited aspect of the invention entails a bag placer system for moving valve-type bags one at a time from a horizontal stack of folded empty bags to place such bag on the horizontal spout of the bag filling machine with the spout received in the valve of the bag, said system comprising a slide block mounted for horizontal reciprocation between retracted and extended positions respectively relatively far and near the stack of bags, a placer crank arm pivotally connected at one end to the slide block about a horizontal axis transverse to the movement of the slide block, means operative against an intermediate portion of the extent of the crank arm selectively operable to urge the crank arm from the spout toward the stack and from the stack toward the spout, means for retaining the slide block in its retracted position except when the crank arm extends generally toward the stack, and means for substantially restraining the crank arm against angular movement about its pivotal connection to the slide block when the slide block is displaced from its retracted position, said crank arm having a free end, a placer frame pivotally mounted on the free end of the crank arm about an axis parallel to the axis of the pivotal connection of the crank arm to the slide block, means including a cam for controlling the orientation of the placer frame as a function of the position of its pivotal connection to the crank arm, means carried by the placer frame for releasably engaging a bag, said last means including both a vacuum means that is translated to engage the stack of bags as the slide block moves to its extended position and a snapper means for gripping an edge of a bag when actuated, said snapper means being pivotally secured to the placer frame and yieldingly urged toward an operative position from an inoperative position thereof, and an obstruction adjacent the stack and disposed in the travel path of the snapper means as the slide block moves toward its extended position to force the snapper means into its inoperative position when the slide block is in its extended position.

The invention and advantageous features thereof will be most readily perceived in the light of the following description being given in conjunction with the accompanying drawings, wherein:

FIG. 1 is a side elevational view of the bagging system inclusive of the bag filling machine and the apparatus for sequentially placing bags from a bag magazine in filling position on the bag filling machine;

FIG. 2 is an enlarged fragmentary view of the placer from the rear as the same faces the bag supply magazine, this view being taken upon the plane of the line 2—2 in FIG. 1;

FIG. 3 is an enlarged fragmentary side elevational view of the placer as the latter is disposed in FIG. 2 and illustrates particularly the pneumatically actuated snapper structure;

FIG. 6 is a fragmentary side elevational view of the apparatus with the shielding removed showing the placer extended with the outer jaw of the snapper in engagement with the bag supporting stand;

FIG. 7 is an enlarged isometric view of the snapper showing the same in open position;

FIG. 8 is a fragmentary isometric view of the gripping end of the snapper and showing the same in closed or bag gripping position;

FIG. 9 is a fragmentary side elevational view of the bag supply means and the adjacent portion of the bagger with the placer retracted;

FIG. 10 is a fragmentary rear elevational view of the bag supply means;

FIG. 11 is a broken isometric detail view of the means for advancing the horizontal stack of bags toward the placer; and, FIG. 12 is a broken side elevational detail view of the bag advancing means.

FIG. 13 is a schematic of the pneumatic actuating means.

Figure 4:
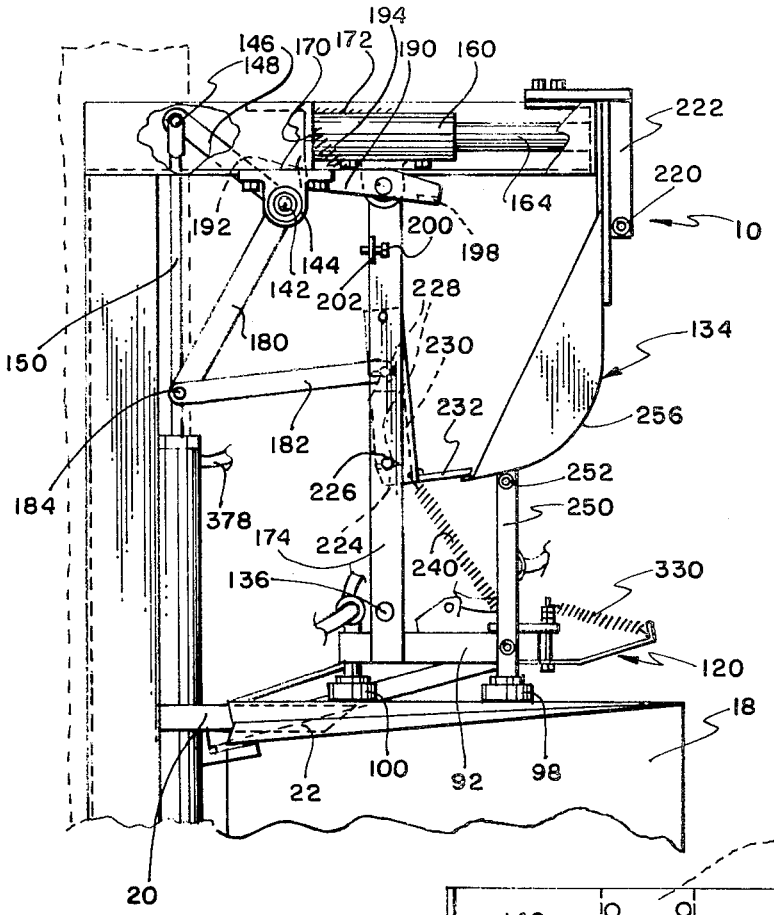
FIG. 4 is a fragmentary side elevational view of the placer with the protective shielding removed, and illustrates particularly the placer articulation and cam guidance means and shows the positions of the placer and the snapper relative to the bag filling spout when a bag is positioned on the latter.

Referring now to the drawings wherein like numerals designate like parts throughout the various views, the reference numeral 10 designates generally the automatic system which comprises an automatic bag filling machine or bagger designated generally at 12, a bag supply means or magazine 14, and a bag placing means 16 that automatically removes one valve-type bag 18 at a time from the magazine 14 and places the same on the horizontal fill spout 20.

The automatic bag filling machine 12 is of conventional character and is of the type that alternates between a bag filling condition and a bag discharge condition. The machine 12 conventionally includes means, not shown, to sense the placement of an empty bag on the filling spout 20 so that the bag is supported on the spout 20 with the latter extending into the valve 22 of the bag 18. On sensing a bag properly positioned on the spout, the machine includes conventional means, not shown, to clamp the bag on the spout and means, not shown, commences to blow air and the material with which the bag is to be filled into the bag through the valve 22. This causes the bag to unfold and be filled while suspended on the spout 20 over a bag kicker or discharge means 24. Excess air introduced into the bag, that is air in excess of that necessary to inflate or distend the bag during filling, escapes through the valve 22 about the spout 20.

Concurrently with the sensing of the placement of the bag so as to clamp the bag and to initiate the filling operation described above, means is provided, not shown, to effect brief electrical energization of a solenoid controlled bleeder valve 26 (see FIG. 2) for a purpose later to be set forth. Also concurrently with such initiation of the fill cycle the packer or bag filling machine 12, which is preferably pneumatically operated, applies air pressure to a line 28 while relieving or exhausting pressure in a line 30, it being understood that intermediate fill cycles the line 30 is pressurized while line 28 is exhausted or relieved of pressure. Such synchronization of pressurization of the lines 28 and 30 with the conventional automatic pneumatic control system (not shown) is diagrammatically illustrated in FIG. 13 wherein a block diagram illustration of the packer 12 is shown as being connected to the lines 28 and 30.

Conventional means, also not shown, is provided to sense when the bag 18 is filled. Such means can and are customarily such as to respond to the bag and its contents attaining a predetermined weight. On sensing the bag 18 being filled, the machine 12 then automatically exhausts or vents the line 28 and applies air pressure to the line, and such pressure control of the lines 28 and 30 is maintained until another fill cycle is initiated as outlined above.

Other than pneumatically operated bag filling machines can be employed, however, essentially all such machines alternate between two states or operation intervals, namely, a fill interval initiated by placement of a bag in readiness to be filled and a filled bag discharge interval that is initiated on a bag having been filled. It will become evident to those conversant with the art as the following description of the present invention proceeds that means can be provided to alternately connect a source of pressurized air respectively to the lines 28 and 30 (the other to be vented) depending whether a fill interval or bag discharge interval has last been initiated, and the provision of such means is clearly within the ordinary capabilities of such persons.

The bag supply means 14 comprises an upstanding open steel framework or stand 30 sharing a common base or platform 32 with a frame 34 constituting a part of the machine 12. Braces 35 interconnect the frames 30 and 34 so as to reinforce the structure of the system and to maintain the bag supply 14 in fixed spatial relation to the machine 12.

Disposed at the top of the stand 30 are means 36 for holding a horizontal stack 38 of folded bags and for automatically feeding the stack 38 toward the end of the stand 30 nearest the machine 12. The means 36 includes a horizontal transverse member 40 at the lower edge of the end of the stack adjacent the machine 12 as well as an open upstanding structure 42 of inverted U-shape configuration for engaging marginal edge portions of the stack 38 to restrain movement of the bag 18 nearest the machine 12 toward the latter. The means 36 includes spaced longitudinal supports 46 and 48 upon which the stack of bags 38 rests. The means 36 includes a bag pusher means 50 that engages the end of the stack 38 furtherest removed from the machine 12, and the means 50 automatically urges the stack 38 toward the machine 12. The means 50 comprises a channel 52 disposed between the members 46 and 48. The pusher means 50 includes a slide 54 atop the channel 52 that has depending and inturned flanges 56 slidingly embracing lateral edges 58 of the channel 52. An upstanding pusher frame 60 is fixed to the slide 54 to engage the back of the stack 38.

An endless drive chain 62 having its upper flight 64 disposed within the channel 52 and its lower flight 66 disposed below the channel is provided, the same being extended about a pair of upper sprockets 68 and 70 mounted within the channel 52 and a pair of lower sprockets mounted below the channel 52. The sprockets 68, 72 and 74 are idler sprockets, while the shaft 76 of the sprocket 70 is driven by an electric motor with suitable reduction gear, not shown. A normally closed electric switch means 80 is disposed at the end of the stand 30 nearest the machine 12 and in the travel path of the stack 38 so as to be engaged and opened by the latter when the stack 38 is disposed to bear against the structure 42. The electric drive means, not shown, for the sprocket 70 is controlled by the switch 80 so as to be energized solely whenever the stack 38 is not against the structure 42 as will be readily understood.

The slide 52 has a ratchet lever 82 pivoted thereto that normally engages the chain 62 so that the latter drives the slide 54. The ratchet 82 can be manually disengaged from the chain 62 so that the same can be repositioned on the channel 52 to replenish the supply of bags 18 in the stack 38. After the supply is replenished, the slide 54 can be moved to contact the pusher structure 60 with the back of the stack 38 and the ratchet 82 being thereafter engaged with the chain 62.

Proceeding now to the bag placing means 16, the same will be seen to comprise a placer frame consisting of a horizontal tubular frame member 86 of rectangular cross section that has an L-shaped extension 88 detachably secured to one end thereof by threaded fastening means 90, and which has a transversely extending frame member 92 detachably secured to its other end by threaded fastening means 94 as best shown in FIG. 2.

Vacuum or suction means inclusive of interconnected vacuum cups 96, 98 and 100 are provided for engaging the bag 18 of the stack nearest the machine 12 when the placer frame 86 is extended toward the stack 38 as will be explained shortly. The cup 96 is mounted at the free end of the extension, while the cups 98 and 100 are respectively mounted at the upper and lower ends of the placer frame member 92. The suction cups 96, 98 and 100 are conventionally connected via flexible lines; cup 98 being connected to a junction 102 between lines 104 and 106; cup 96 being connected to line 106; and cup 100 being connected to a junction between lines 104 and 108, the latter line being normally connected via the solenoid bleeder valve 26 and a line 110 to a continuously operating vacuum pump, not shown. The valve 26 has connection to ambient atmosphere by connection 112 whereby any vacuum existing in the cups 96, 98 and 100 is relieved.

A snapper or bag edge gripper designated generally at 120 is detachably mounted on the placer frame 86 by threaded means indicated at 122.

Means is provided for guidingly moving the placer frame 86, the vacuum cups 96, 98 and 100 and the snapper 120 carried thereby. Such means comprises a pneumatically powered articulation means 132 and cam means 134 for orientating the placer frame 86 about a horizontal axis 136 defined by a pivotal connection between the placer frame 86 and the means 132.

The means 132 comprises the frame 34 having a rigid top section 140 projecting horizontally toward the bag supply means 14 and a transverse horizontal shaft 142 is journaled in a pair of spaced bearings 144 carried by the frame 140. An arm 146 has one end fixed to the shaft 142 and its other end is pivotally connected at 148 to the free end of the piston rod 150 of a double-acting pneumatic actuator that includes a substantially vertical cylinder 152. The lower end of the cylinder 152 at 154 is pivotally mounted on the frame 34. Extension and retraction of the piston rod 150 respectively rocks the shaft 142 clockwise and anticlockwise as viewed in FIG. 6 with the pivotal mounting 154 accommodating the minor degree of rocking of the cylinder 152 incident thereto.

Figure 5:
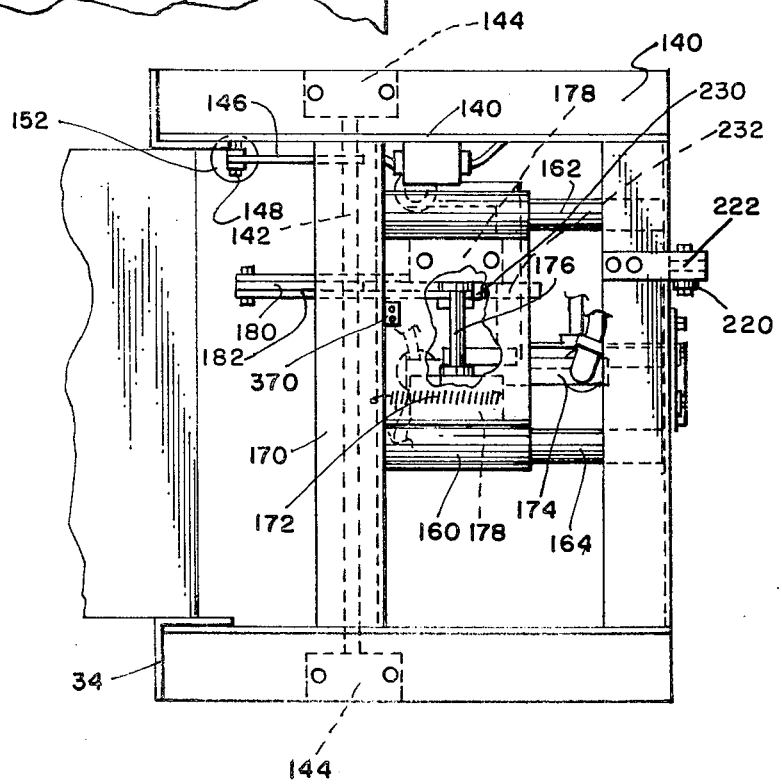
FIG. 5 is a top view of the structure shown in FIG. 4 with certain hidden details being shown in dashed outline.

The frame extension 140 carries a horizontally reciprocable slide block 160. The slide block is slidably journaled on a pair of horizontally extending and parallel rods 162 and 164 that are fixed to the frame 140. The slide block 160 is movable between extended and retracted positions respectively shown thereof in FIGS. 5 and 6. The frame 140 includes a transverse angle iron 170 and a coiled tension spring 172 is connected between the angle iron 170 and the slide block 160 to yieldingly urge the latter toward its retracted position.

A placer crank arm 174 has one end fixed to a shaft 176 journaled to extend between pillow blocks 178 mounted on the underside of the slide 160, and the free end of the arm 174 is pivotally secured at the pivotal connection 136 to the placer frame member 92. The shaft 142 is coupled to the arm 174 by a pair of links 180 and 182 having ends that are pivotally connected at 184; with the remote ends of the links 180 and 182 being respectively fixed to the shaft 142 and pivoted at 186 to the arm 174 at a position intermediate the ends of the latter.

Means is provided for releasably retaining the slide block 160 in its retracted position, such means comprising a lever 190 journaled intermediate its ends on the shaft 176 and having an upstanding hook 192 on one end thereof that is urged upwardly by a tension spring 194 connected between the slide 160 and the lever 190 so as to be engageable with the angle iron 170 when the slide 160 is retracted. When the hook 192 is engaged with the angle iron 170 as shown in FIG. 4, the slide block 160 is positively restrained against extension.

The other end of the lever 190 is provided with a laterally extending tab that is disposed in the travel path of the head 200 of an abutment adjustably threaded through a laterally extending flange 202 on the arm 174 as best shown in FIG. 4.

As thus far described, it will be seen that with the parts oriented as shown in FIG. 4, retraction of the piston rod 150 causes anticlockwise swinging movement of the link 180 and this, in turn, forces anticlockwise swinging movement of the placer crank arm 174 while the slide 160 is retained in its retracted position until the arm 174 has swung sufficiently to engage the tab 198 and to move the lever 190 to release the hook from the angle iron 170.

Further upward swinging movement of the arm 174 is limited by engagement of the lever 190 with the underside of the slide block and by the engagement of the abutment 200 engaging the tab 198 whereupon further retraction of the piston rod 150 moves the slide block 160 from its retracted to its extended position.

It should be noted that the tension of the spring 172 can be sufficiently great that when the piston rod 150 is extended from its retracted position, the sequence of movements of the arm 174 and slide block 160 is reversed, namely, the slide block 160 will fully retract prior to downwardly swinging movement of the arm 174, whereby the hook 192 can reengage the angle iron concurrently with the commencement of downward movement of the arm 174 that permits it so to do under the influence of the spring 194.

The spring 172 need not be of such strength as to assure the described movement of the parts as will be seen presently.

Supplementing or serving in lieu of the described action of the spring 172 is the provision of an arm support roller 220 mounted on a depending portion 222 of the frame 140 for rotation about a transverse horizontal axis. For the purpose of coacting with the roller 220, an elongated roller guide bracket 224, which is L-shaped in transverse section, has one side thereof attached to one side of the crank arm 174 by means of threaded fasteners 226 extending through oversized and elongated openings 228 in the bracket 224 whereby the latter can properly be adjusted and secured on the arm 174. The other side 230 of the bracket 224 projects at right angles from the adjacent side of the arm 176 and the longitudinal extent of the bracket 224 generally parallels the arm 174. The end of the bracket side 230 nearest the pivotal connection 136 is provided with an upstanding flange 232 (as viewed in FIG. 6).

The operation of the guide bracket 224, particularly the side 230 and flange 232, will be readily understood. Assuming the initial position of parts shown in FIG. 4, retraction of the piston rod 150 causes the arm 174 to swing upwardly and just prior to the abutment 200 contacting the tab 198, the flange 232 moves upwardly immediately to the left of the roller 220 as the latter is viewed in FIG. 4 so as to prevent movement of the slide block 160 until the lower end of the flange 232 and the bottom of the bracket side 230 has cleared the top of the roller 220. Upon sufficient upward swinging movement of the arm 174 to allow the bottom of the bracket side 230 to clear the top of the roller 220, the abutment 200 will have advanced sufficiently to have disengaged the hook 192 whereupon the slide block 160 is free to move toward its extended position shown in FIG. 6. As the slide block 160 moves toward and to its fully extended position, the arm 174 is supported by and guided by the bracket 224 as the underside of the side 230 thereof rests on the roller 220, thus rendering any support by action of the spring 172.

Though for purposes of illustration, the bracket 224 departs somewhat from the horizontal (as permitted by the size of the mounting openings 228), it is preferred that the same be oriented horizontally so that the arm 174 does not rotate appreciably during sliding of the slide block 160 and is essentially translated only in unison with the horizontal movement of the slide block.

On extension of the piston rod 150, the arm 174 is guided and supported by the coaction of the roller 220 and the bracket 224 until the slide block 160 has been fully retracted with the flange 232 clearing the roller 220 and with the hook 192 reengaging the angle iron 170 after which the arm 174 can swing downwardly, on further extension of the piston rod 150, to resume the position shown thereof in FIG. 4.

Attention is now given to the means 134 for controlling the attitude of the placer frame 86 during movement of the arm 174 between the positions shown thereof in FIGS. 4 and 6. The means 134 comprises the pivotal connection 136 incorporating a stop (not shown) that limits anticlockwise movement of the placer frame 86 relative to the arm 174 to that shown in FIG. 6 wherein the non-colinear vacuum cups 96, 98 and 100 lie in a common vertical plane, and a coiled tension spring 240 connects the bracket 224 and the placer frame 92 to yieldingly urge anticlockwise movement of the latter relative to the arm 174.

The means 134 also includes cam means now to be described for causing clockwise angular departure of the placer frame 86 relative to the arm 174 as a function of the position of the latter. Such cam means comprises a cam stem 250 fixedly extending from the placer frame member 92 and has a roller 252 rotatably mounted on its free end for coaction with a cam body 254 having a curved cam surface 256 for coaction with the roller 252.

The relationship of the cam surface 256 to the position of the cam roller 252 and the pivot 236 is such that as the arm 174 is moved from the position shown thereof in FIG. 6 to the position shown in FIG. 4, the plane of the vacuum cups 96, 98 and 100 remains vertical until the slide block 160 is retracted with coincident engagement of the roller 252 with the cam surface 256. At this point the arm 174 swings downwardly with the roller 252 continuously bearing on the cam surface 256. The latter surface causes oscillation of the placer frame 86 such that the plane of the vacuum cups 96, 98 and 100 reaches and passes through horizontal orientation prior to the arm 174 reaching its FIG. 4 position and assumes its essentially horizontal position illustrated in FIG. 4 at approximately the conclusion of movement of the arm 174. In other words, the plane of the suction cups 96, 98 and 100 rotates clockwise as viewed in FIG. 6 from the vertical for somewhat more than 90° prior to the arm 174 reaching its position shown in FIG. 4 and returns to the horizontal during the final few degrees of movement of the arm 174. As will be seen presently, such approach or tilt from the horizontal as the placer frame 86 approaches its final position is to accommodate insertion of the fill spout 20 into the valve 22 of the bag 18.

It will be understood that movement of the placer frame 86 from its FIG. 4 to its FIG. 6 position is essentially an exact reversal of the movement thereof above described.

The structure and function of the snapper 120 will now be explained. The snapper 120 comprises an elongated snapper frame 260 formed of a base plate 262 having integral side flanges 264 and 266. Spaced plates 268 and 270 are rigidly fixed to the slide walls 264 and 266 respectively, and the cylinder 272 of a double-acting pneumatic assembly 274 is disposed between such plates. One end of the cylinder 272 has pivotal connection to the snapper frame 260 by means of a pivot pin 276 as best shown in FIG. 7. The pneumatic actuator 274 includes a piston rod 278 that can be retracted and extended from the cylinder 272 as shown in FIGS. 7 and 8.

A substantially flat T-shaped inner jaw 280 is hingedly connected by a pivot pin 282 to one end of the snapper frame 260 for swinging movement about an axis transverse to the extent of the snapper frame 260. The free end or edge of the inner jaw 280 is hingedly connected at 284 to the inner edge of a generally rectangular outer jaw 286.

An L-shaped actuator arm 288 has one leg thereof attached or rigidly fixed to an outer face 292 of the outer jaw 286, and the free end of the other leg 294 is pivotally connected by means including a clevis 296 to the free end of the piston rod 278. A coiled tension spring 300 is looped over the free end of the cylinder 272 and has its free ends attached to the side walls 264 and 266 so as to yieldingly urge such free end of the cylinder 272 toward the base 262 of the snapper frame 260.

The inner jaw 280 is swingable between the position shown thereof in FIG. 7 to the position shown thereof in FIG. 8, further swinging of the inner jaw 280 being prevented by engagement with the snapper base 262 which underlies the same. The jaws 280 and 286 have inner faces or sides that close against each other upon a plane essentially coplanar with the plane of the snapper base 262 when the piston rod 278 is extended as shown in FIG. 8, it being noted that the spring 300 serves to assure the inner jaw 280 being swung to its illustrated closed position in FIG. 8.

Retraction of the piston rod 278 from the position shown thereof in FIG. 8 to the position shown thereof in FIG. 7 serves to swing the jaws 280 and 286 about their parallel axes to the positions shown thereof in FIG. 7 such that they are raised from the plane of the snapper base 262.

The snapper frame 260 is pivotally mounted upon the placer frame 86 by means comprising a U-shaped mounting bracket 320 that includes a web 322 connecting legs 324 and 326. The legs 324 and 326 are pivotally connected to the side walls 264 and 266 by a pivot pin 328. A coiled tension spring 330 is connected to yieldingly urge rotation of the bracket 320 to an extent ultimately limited by engagement of the web 322 with the plates 268 and 270 as plainly shown in FIG. 7. Such rotation of the bracket 320 in such one direction can be adjustably further limited by means of a stop member 332 adjustably threaded through the web 322 to adjustably position a stop 334 relative to the web 322, such stop 334 being engageable with the base 262 of the snapper frame 260.

The web 322 is provided with a plurality of openings 340 therethrough, and the snapper 120 is secured to the placer frame 86 by the previously mentioned threaded fastener 122 that extends through the placer frame 86 and a selected one of the openings 340.

The mounting of the snapper 120 on the frame 86 is such that in repose the snapper frame 260 is swung anticlockwise about its pivot means 328 from the position shown thereof in FIG. 6 so that the jaws 280 and 286 would swing to the right of the vertical plane of the vacuum cups 96, 98 and 100 were it not for the engagement of the jaws with horizontal transverse member 40. Indeed, the snapper frame 260 is swingable not only anticlockwise from the position shown thereof in FIG 6.

As thus far described, it will be understood that further retraction of the piston rod 150 from the position shown thereof in FIG. 6 will cause the placer frame 86 to move further to the right and to push the vacuum cups 96, 98 and 100 firmly against the first of the stacked bags 38 whereupon the vacuum applied to such cups yields a fairly secure hold on the bag, it being noted that such further modest movement of the placer frame 86 results in yet more clockwise movement of the snapper frame 260.

After the vacuum pick-up of the bag as described above, extension of the piston rod 150 will pull the first bag from the stack 38 and pull such first bag free of the edge restraint of the members 42, though the latter retains the remainder of the stack 38 by engaging their edge margins.

As the bag 18 is further translated to the left as viewed in FIG. 6, a lower edge portion of the folded bag 18 that is disposed at one side of the folded and valved top of the bag is moved to a position spaced from the stack 38 and directly opposed to the open jaw 280; the arrangement being such that the lower edge portion of the bag 18 opposed to the jaw 280 can subsequently be gripped between the jaws 280 and 286 on closure of the latter.

Eventually the outer jaw 286 is moved from contact with the member 40 by which time the snapper frame 260 will have rotated anticlockwise to its position of repose such that the jaw 280 engages the bag 18 with the open outer jaw 286 extending below the edge of the bag. Such relative movement of the snapper 120 relative to the plane of the vacuum cups 96, 98 and 100 causes relative movement of bag portions such as to open the bag valve 22 as can be seen in FIG. 4.

The plane of vacuum cups 96, 98 and 100 is referred to as the plane of engagement in the appended claims and it will be seen that the jaws of the snapper swing forwardly and rearwardly of said plane.

Movement to the rear of such plane is the consequence of the jaws encountering the structure associated with supporting and feeding the stack of bags 38; this movement occurring when the suction cups are being forwardly advanced to securely engage and obtain purchase upon the nearest bag of the stack. Such rearmost movement is resiliently opposed by the spring 330 as previously explained.

Forward movement of the jaws is urged by the spring 330, and if desired the strength of the spring 330 can be sufficient to cause all the movement of the jaws in forward direction necessary to move the jaws forwardly enough to cause the latter to bend the bag 18 and to cause opening of the valve 22 on the jaws moving forwardly of the plane of engagement; however, it is preferred that such forward movement be caused by a combination of the action of the spring 330 and certain gravitational factors now to be explained.

The snapper has its center of mass intermediate the jaws and its pivotal axis 328 so that the jaws 280 and 286 are gravitationally urged to be more or less directly below the axis 328. Preferably the spring 330 has insufficient strength to fully open the bag valve 22, the arrangement being such that the bag 18 is only modestly flexed by the snapper until the slide block has been fully retracted and the jaws closed, the snapper to this point having rotated only a modest degree anticlockwise from the position shown thereof in FIG. 6.

Upon the subsequent clockwise rotation of the placer frame and the plane of engagement as the bag 18 is rotated and moved toward the spout 20, the snapper is gravitationally urged anticlockwise and such relative movement progressively urges opening of the bag valve 22 while the bag 18 is firmly gripped by the snapper.

If desired or deemed expedient, the gravitational means described can be used entirely in lieu of rather than merely to augment the spring means.

Means are provided for pneumatically actuating the means 274 to close the jaws 280 and 286 and cause the latter positively to grip the lower bag edge therebetween after the jaw 286 has been pulled free of the frame member 40.

Such means for pneumatically actuating the means 274 includes a normally closed air valve 370 disposed in the travel path of the slide block 160 in an arrangement such that the valve 370 is opened solely when the slide block 160 is at its retracted position adjacent the angle iron 170.

The means by which the movement the placer theplacer frame 86 is synchronized with the phase of cyclic operation will now be explained in connection with FIG. 13. As mentioned previously, the lines 28 and 30 are respectively pressurized when the machine is in its filling interval and in its bag discharge interval. The line 28 is coupled to a line 376 which, in turn, is connected by a line 378 to the cylinder so that pressurization of the line 28 causes retraction of the piston rod 150. In a similar fashion the line 30 is connected to a line 380 which is, in turn, coupled by a line 382 to the cylinder 152 to cause extension of the piston rod 150. Accordingly, as soon as a bag 18 is properly positioned on the spout 20 as in FIG. 4, the piston rod 150 is retracted to move the vacuum cups 96, 98 and 100 against the first bag in the stack 38. As soon as the bag on the spout 20 is filled, the piston rod 150 is extended to return the placer frame 86 to its position in FIG. 4.

The line 376 is coupled to the cylinder 172 by a line 390 so that pressurization of the line 28 causes retraction of the piston rod 278 and opening of the jaws 280 and 286. The line 380 is coupled via the normally closed valve 370 to a line 392 connected to the cylinder 172 so that pressurization thereof urges extension of the piston rod 278 and closure of the jaws 280 and 286. Accordingly, the jaws 280 and 286 are opened throughout the fill cycle of the machine, and are closed during only such portion of the filled bag discharge interval that the slide block 160 is retracted to open the valve 370.

The bag discharge means 24 includes a seat 400 pivotally mounted at 402. Pneumatic means inclusive of an air relay 404 is provided to rock the seat 400 about its pivot 402 and to return the seat 400 to its illustrated position once on each pressurization of the line 30, whereby a filled bag 18 is lifted and moved from the spout 20 and onto a conveyor or the like, not shown.

The asymmetric position of the cup 96, the snapper 120, and the cups 98 and 100 shown in FIG. 2 is quite apparent and is such as to accommodate bags of what may be termed a right-hand arrangement such that the folded bag tops confront the cups 98 and 100. The illustrated apparatus is readily convertible to handle with exactly equal facility bags that are stacked left handedly. Such conversion entails reconnecting the frame 86 to the frame 92 so as to extend to the right, rather than from the left of the latter, and to reconnect the snapper 120 to the frame member 86 so that the jaws 280 and 286 are lowermost. With such rearrangement having been made, the stand 30 is laterally shifted (or reconnected to the frame 34 by means not shown) to such extent as may be necessary to place the valves 22 of the stacked bags 38 in proper orientation with the spout 20 and to dispose the tops of such stack of bags 38 in alignment with the cups 98 and 100. The means for laterally shifting or reorienting the stand 30 is thought to be plainly within the skill of the art.

In the interest of safety and/or to comply with governmental regulations pertaining to safety, the projecting portion of the frame 140 is provided with a protective envelope or hood structure 420 largely shielding the means 132. Preferably the hood or shield means is made of expanded sheet steel.

As further elaboration of the invention and its operation would serve no useful purpose for those familiar with the art, attention is now directed to the appended claims.

I claim:

1. A snapper comprising an elongated support member having forward and rear sids, jaw means carried by the support member at an end of the latter for releasably gripping an edge of a flat object disposed at the forward side of the support member, said jaw means comprising inner and outer jaws, said inner jaw having inner and outer edges and being hingedly connected along its inner edge to the support member for forward and rearward swinging movement about a transverse axis, said outer jaw having an inner edge and an outer edge and being hingedly connected along its inner edge to the outer edge of the inner jaw for swinging movement, said jaws having sides adapted to grip an object therebetween when the jaws are both swung in a closing direction that corresponds to forward swinging movement of the inner jaw, and jaw operating means carried by and disposed on the rear side of the support member for controllably swinging the jaws in said closing direction and in a direction opposite thereto to open the jaws.

2. The combination of claim 1, including a movably mounted frame provided with suction means operative upon an engagement plane that is fixed in spatial relation to the frame to engage an impervious flat object forwardly thereof, means pivotally mounting the support member for swinging movement of the jaw means between positions forwardly and rearwardly of the plane of engagement, and means yieldingly urging the jaws forwardly of the plane of engagement.

3. The combination of claim 2, including means for supporting a stack of flat objects, said last means being in part disposed in the travel path of the jaw means during movement of the frame in an arrangement such that the jaw means swings rearwardly of the plane of engagement against the action of the means urging the same forwardly thereof as the frame is moved in a forwardly direction.

4. The combination of claim 3, including means for controlling the jaw operating means to maintain said jaws open when the jaws are disposed rearwardly of the plane of engagement.

5. The combination of claim 4, wherein the plane of engagement is defined by a non-colinear plurality of suction cups carried by the frame.

6. Bag placing apparatus of the class including a plurality of vacuum cups carried by a placer frame for engaging and pulling a bag from a stack of folded bags on sequentially moving the placer frame toward and away from the stack, said placer frame having in combination therewith a snapper means actuable to releasably grip a bag engaged by the vacuum cups, said snapper means being mounted on the placer frame for movement relative thereto between inoperative and operative positions, and means for moving the snapper means to its inoperative position and preventing actuation thereof.

7. The combination of claim 6, including means operative in response to a predetermined movement of the placer frame from the stack to move the snapper means to its operative position and to actuate the latter.

8. The combination of claim 6, wherein the last recited means includes an element disposed in the travel path of the snapper means as the placer frame moves toward the stack, and means yieldingly urging the snapper means toward its operative position.

9. A bag placer system for moving valve-type bags one at a time from a horizontal stack of folded empty bags to place such bag on the horizontal spout of a bag filling machine with the spout received in the valve of the bag, said system comprising a support pivot connected to a placer frame about a horizontal axis that is perpendicular to the spout with respect to the horizontal plane, means for selectively moving the support pivot in either direction along a path disposed in a vertical plane and having a first position relatively adjacent the spout and a second position relatively adjacent the stack, means operative to control the angular orientation of the placer frame about said axis as a function of the position of the support pivot along said path, said orientation of the placer frame differing about 90° when the support pivot is in its first and second positions, and said placer frame being provided with means for releasably holding a bag.

10. The combination of claim 9, wherein the means for selectively moving the support pivot is caused to move the latter toward its second position in response to initiation of a fill cycle by the bagging machine and toward the first position in response to conclusion of a fill cycle.

11. The combination of claim 9, wherein the means for selectively moving the support pivot includes pneumatic means, and wherein said bagging machine also includes pneumatic means alternately operable during fill and intermediate fill cycles, and means interconnecting first recited pneumatic means and the pneumatic means of the bagging machine for causing the selective means to move the support pivot from its first to its second position upon initiation of each fill cycle and from its second position to its first position upon termination of each fill cycle.

12. The combination of claim 9, wherein said means for controlling the angular orientation of the placer frame includes a cam having a surface determining said function.

13. The combination of claim 12, wherein the orientation of the placer frame varies through a range in excess of 90° as the support pivot moves between its second position and a position intermediate its first and second positions.

14. The combination of claim 9, wherein said means for releasably holding a bag comprises both a vacuum means and a pneumatically operated snapper means for releasably gripping an edge margin of a bag.

15. The combination of claim 14, wherein said vacuum means and the snapper means are selectively secured to the placer frame in differing positions, whereby they can be reversed as to their order relative to the vertical plane so that the placer system can be converted to handle either right-hand or left-hand stacks of bags.

16. A bag placer system for moving valve-type bags one at a time from a horizontal stack of folded empty bags to place such bag on the horizontal spout of the bag filling machine with the spout received in the valve of the bag, such system comprising a slide block mounted for horizontal reciprocation between retracted and extended positions respectively relatively far and near the stack of bags, a placer crank arm pivotally connected at one end to the slide block about a horizontal axis transverse to the movement of the slide block, means operative against an intermediate portion of the extent of the crank arm selectively operable to urge the crank arm from the spout toward the stack and from the stack toward the spout, means for retaining the slide block in its retracted position except when the crank arm extends generally toward the stack, and means for substantially restraining the crank arm against angular movement about its pivotal connection to the slide block when the slide block is displaced from its retracted position, said crank arm having a free end, a placer frame pivotally mounted on the free end of the crank arm about an axis parallel to the axis of the pivotal connection of the crank arm to the slide block, means including a cam for controlling the orientation of the placer frame as a function of the position of its pivotal connection to the crank arm, means carried by the placer frame for releasably engaging a bag, said last means including both a vacuum means that is translated to engage the stack of bags as the slide block moves to its extended position and a snapper means for gripping an edge of a bag when actuated, said snapper means being pivotally secured to the placer frame and yieldingly urged toward an operative position from an inoperative position thereof, and an obstruction adjacent the stack and disposed in the travel path of the snapper means as the slide block moves toward its extended position to force the snapper means into its inoperative position when the slide block is in its extended position.

17. The combination of claim 16, wherein said snapper is pivotally secured to the placer frame at a position spaced from its center of mass whereby the snapper is yieldingly urged toward its operative position.

18. The combination of claim 17, wherein said placer frame is rotated in one direction as the crank arm is moved from the stack toward the spout, said one direction being opposite that of pivotal movement of the snapper toward its operative position, whereby the snapper is urged with progressively greater force toward its operative position as the placer frame is rotated.

19. In a bag placer for moving valve-type bags from a stack thereof onto a horizontal filling spout while turning the bag in one direction through an angle, the improvement therein comprising said placer having first and second relatively rotatable bag holding means, said first means including a suction cup for engaging a bag upon a plane of engagement, means for moving said first holding means to effect the movement and turning of the bag, said second means being pivotally connected to the first means for relative pivotal movement in said one direction and in the opposite direction respectively toward retracted and extended positions thereof, said second means including jaws operable to grip an edge of a bag therebetween, said jaws being disposed respectively on opposite sides of the plane of engagement when the second means is retracted and extended, and means yieldingly urging movement of the second means toward its extended position from its retracted position, whereby the valve of a bag is progressively opened when such bag is held by the first and second holding means and the latter is moved toward its extended position.

20. The combination of claim 19, wherein the last recited means comprises the second means having a center of mass displaced from its pivotal connection to the first means.

21. The combination of claim 19, wherein the last recited means comprises a spring.

22. The combination of claim 19, wherein the last recited means comprises the second means having a center of mass displaced from its pivotal connection to the first means, together with a spring connecting said first and second holding means.

* * * * *